United States Patent [19]

Ward et al.

[11] 4,075,013

[45] Feb. 21, 1978

[54] ELECTROPHOTOCHEMICAL PREPARATION OF SELENIUM PHOTOCONDUCTIVE MEMBERS

[76] Inventors: Anthony T. Ward, 934 Little Pond Way, Webster, N.Y. 14580; Aleksandar Damjanovic, 809 Harbor Square, Rochester, N.Y. 14617; Michael L. Hair, 2367 Bennington Gate, Oakville, Ontario, Canada, L6J 5N7

[21] Appl. No.: 722,914

[22] Filed: Sept. 13, 1976

[51] Int. Cl.[2] ..... G03G 5/04

[52] U.S. Cl. ..... 96/1.5 R; 427/53; 204/38 R

[58] Field of Search ..... 96/1.5; 204/38 R, 33; 427/83, 53, 54

[56] References Cited

U.S. PATENT DOCUMENTS

| | | | |
|---|---|---|---|
| 2,649,409 | 8/1953 | Hippel et al. | 204/38 R |
| 3,615,405 | 10/1971 | Shebanow | 204/38 R |

*Primary Examiner*—David Klein
*Assistant Examiner*—John L. Goodrow
*Attorney, Agent, or Firm*—James J. Ralabate; James P. O'Sullivan; Gaetano D. Maccarone

[57] ABSTRACT

A method for forming an electrophotographic imaging member comprising electrochemically depositing amorphous selenium on a conductive substrate while simultaneously illuminating the substrate with electromagnetic radiation through a periodic spatial light modulating means. The deposited selenium layer has a periodically varying thickness. The selenium layer is then overcoated with a layer of a charge carrier transport material which is capable of transporting at least one species of charge carrier. The resulting imaging member has extended range and solid area reproduction capability.

7 Claims, 3 Drawing Figures

ELECTROPHOTOCHEMICAL PREPARATION OF SELENIUM PHOTOCONDUCTIVE MEMBERS

BACKGROUND OF THE INVENTION

This invention relates to a process for preparing electrophotographic imaging members. More specifically the invention is directed to an electrophotochemical method for preparing electrophotographic imaging members comprising a layer of selenium having a periodic spatially modulated thickness.

The formation and development of images on an imaging member of photoconductive materials by electrostatic means is well known. The best known of the commercial processes, more commonly known as xerography, involves forming an electrostatic latent image on the imaging layer of an imaging member by first uniformly electrostatically charging the surface of the imaging layer in the dark and then exposing this electrostatically charged surface to a light and shadow image. The light struck areas of the imaging layer are thus rendered relatively conductive and the electrostatic charge selectively dissipated in these irradiated areas. After the photoconductor is exposed, the latent electrostatic image on this image bearing surface is rendered visible by development with a finely divided colored electroscopic powder material, known in the art as "toner". This toner will be principally attracted to those areas on the image bearing surface having a relative polarity opposite to the charge on the toner and thus form a visible powder image. The developed image can then be read or permanently affixed to the photoconductor in the event that the imaging layer is not to be reused. This latter practice is usually followed with respect to the binder-type photoconductive films where the photoconductive insulating layer is also an integral part of the finished copy.

In so-called "plain paper" copying systems, the latent image can be developed on the imaging surface of a reusable photoconductor or transferred to another surface, such as a sheet of paper, and thereafter developed. When the latent image is developed on the imaging surface of a reusable photoconductor, the developed image is subsequently transferred to another substrate and then permanently affixed thereto. Any one of a variety of well-known techniques can be used to permanently affix the toner image to the transfer sheet, including overcoating with transparent films and solvent or thermal fusion of the toner particles to the supportive substrate.

In the most popular of the xerographic systems of the type referred to above, the imaging member comprises a photoconductive insulating layer of amorphous selenium on a suitable conductive substrate. Such photoconductive insulating layers are generally prepared by vacuum deposition of selenium under carefully controlled conditions. These vacuum deposition techniques generally do not readily lend themselves to the continuous manufacture of photoconductive image members. Even under carefully controlled conditions, vacuum deposition of photoconductive insulating layers of amorphous selenium may encounter difficulties. For example, lack of uniformity in deposition can lead to so-called "pin holes" in the selenium layer. Spattering of molten selenium from the crucible in the deposition chamber can cause an uneven deposition and blemishes in the surface of the imaging layer. Nor is it uncommon for the vacuum deposition chamber to be contaminated with dust particles which codeposit along with the selenium on the receptive substrate, thus, forming additional imperfections in the surface of the imaging layer. Where such deposition does proceed as intended, the selenium forms a uniform continuous deposit on the conductive substrate.

Amorphous selenium deposits may also be reportedly prepared by electrochemical deposition techniques. Unfortunately deposits prepared in this manner have generally not been suitable for use in electrophotography either because of a high dark decay rate (see A. K. Graham et al, J. Electrochem. Soc., 106:8, 651, 1959) or the lack of uniformity in the coating (see U.S. Pat. No. 2,649,409).

There are also known in the art electrophotographic imaging members wherein the photoconductive insulating layer has a periodically varying thickness. The present application is directed to a process for forming such a member by electrophotochemical means.

SUMMARY OF THE INVENTION

It is therefore an object to provide a method for forming an electrophotographic imaging member.

It is another object of the invention to provide a method for forming an electrophotographic imaging member capable of solid area reproduction.

It is a further object to provide a method for forming an electrophotographic imaging member capable of continuous tone reproduction.

It is still another object of the invention to provide an electrophotochemical method for preparing a photoconductive layer having a periodically varying thickness.

Still further it is an object of the invention to provide a method for forming an electrophotographic imaging member wherein the charge carrier generation and charge carrier transport functions are performed by separate layers within the member.

BRIEF SUMMARY OF THE INVENTION

These and other objects and advantages are accomplished in accordance with the invention by electrochemically depositing amorphous selenium on a conductive substrate while simultaneously illuminating the substrate with appropriate electromagnetic radiation through a periodic spatial light modulating means. The deposited selenium layer has a periodically varying thickness. The selenium layer is then overcoated with a layer of a charge transport material which is capable of transporting at least one species of charge carrier. The resulting imaging member has extended range and solid area reproduction capability.

BRIEF DESCRIPTION OF THE DRAWINGS

For a better understanding of the invention as well as other objects and features thereof, reference is made to the following detailed description of various preferred embodiments thereof taken in conjunction with the accompanying drawings wherein.

DESCRIPTION OF THE PREFERRED EMBODIMENTS

Figure 1:
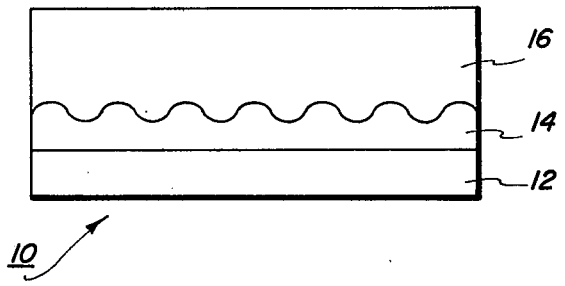
FIG. 1 is a partially schematic, cross-sectional view of an electrophotographic imaging member formed according to the invention.
Figure 2:
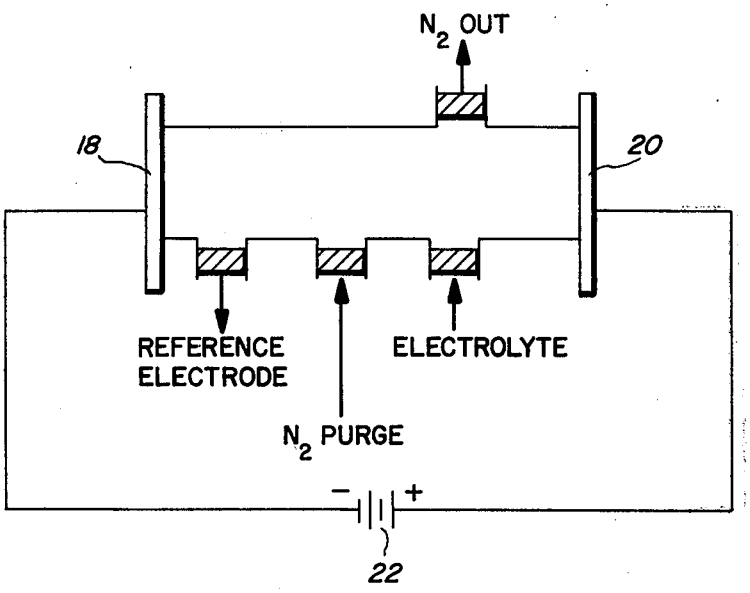
FIG. 2 is a schematic representation of an electrodeposition cell.

Referring now to FIG. 1 there is illustrated an imaging member, generally designated 10, formed according to the invention comprising a conductive substrate 12, a layer of amorphous selenium 14 having a periodically varying thickness and a layer of a charge carrier transport material 16 which is capable of transporting at least one species of charge carrier. The selenium layer 14 is deposited on the substrate 12 by placing the latter in an electrodeposition cell such as that illustrated in FIG. 2 (which may be a cylindrical pyrex cell) as the cathode 18. The cell is closed at the other end by a conductive member 20 which acts as the anode. The cell is filled with an aqueous selenious acid electrolyte at room temperature. The electrolyte can be prepared by dissolving selenium dioxide in triply-distilled water and is channeled into the cell chamber from a reservoir (not shown). The electrolyte typically has a concentration of from about $10^{-2}$M to about 12 M of crystalline selenium dioxide in water.

The conductive substrate 12, which may be opaque or substantially transparent, may comprise many of the materials known for use as conducting substrates for electrophotographic imaging members. It is preferred to utilize substrate materials which will form a blocking contact with the selenium such as, for example, gold, tin-oxide coated glass, nickel and aluminized mylar. These contacts are blocking to electrons because the energy barrier to electron injection resulting from the energy separation between the conduction band in selenium and the Fermi energy level in the substrate is much larger than kT, where kT at room temperature is on the order of 26 millielectron volts (meV). In some instances, such as is the case with metal substrates having electrically insulating metallic oxide surfaces, the electrodeposited selenium will typically not adhere firmly to the substrate surface. When such materials, e.g. zinc and cadmium, are treated to remove the oxide, they may be employed. Conductive layers coated with a non-oxide barrier layer such as a phenoxy resin may also serve as substrate 12 of the imaging member. In the latter case the barrier layer should be relatively thin, e.g. on the order of a few hundred angstroms so as to allow passage of electrons under the selenium electrodeposition conditions. It should be noted that various substrate materials may be more suitable for use with either electron or hole transport materials which may comprise charge carrier transport layer 16 because of the Fermi energy levels of the substrate materials. For example, a nickel-selenium interface is highly blocking to electrons and only moderately blocking to holes. Therefore, the nickel-selenium interface is more appropriate for use in a member where layer 16 comprises an electron transport material. Conductive member 20 may also be opaque or substantially transparent and may comprise any suitable conductive material which will act as the anode in the electrodeposition process.

Passage of a constant current supplied by D.C. energy source 22 through the electrolyte causes reduction of the selenious acid to amorphous selenium at the cathode 18 and oxidation of water to gaseous oxygen at the anode 20. Typically, an approximately 0.15 micron thick amorphous selenium layer can be deposited using a current of $1.5 \times 10^{-4}$ A/cm$^2$ for bout 28 minutes. The maximum current efficiency of one selenium atom deposited for every four electrons passed can be sustained when:

(a) the electrolyte is deoxygenated by purging with inert gas or nitrogen so that oxygen initially present in the electrolyte or generated at the anode is removed instead of being reduced in a competitive reaction at the cathode, e.g.

$$O_2 = 4e^- = 4H^+ \rightarrow 2H_2O \quad (1)$$

b. the concentration of $Se^{iv}$ and $H^+$ in the electrolyte is adequate to sustain the applied current density. For current densities of up to $5.10^{-3}$ A/cm$^{-2}$, $[SeO_2] = 10^{-1}$M and $[H^+] = 10^{-2}$M will be sufficient. Under these conditions, a layer of about 0.15 $\mu$ thickness can be deposited in less than a minute; and c. the resistance drop across the growing selenium layer is prevented from polarizing the cathode to a potential at which competitive reactions, e.g.

$$2H^+ + 2e^- \rightarrow H_2 \uparrow \quad (2)$$

occur.

Figure 3:
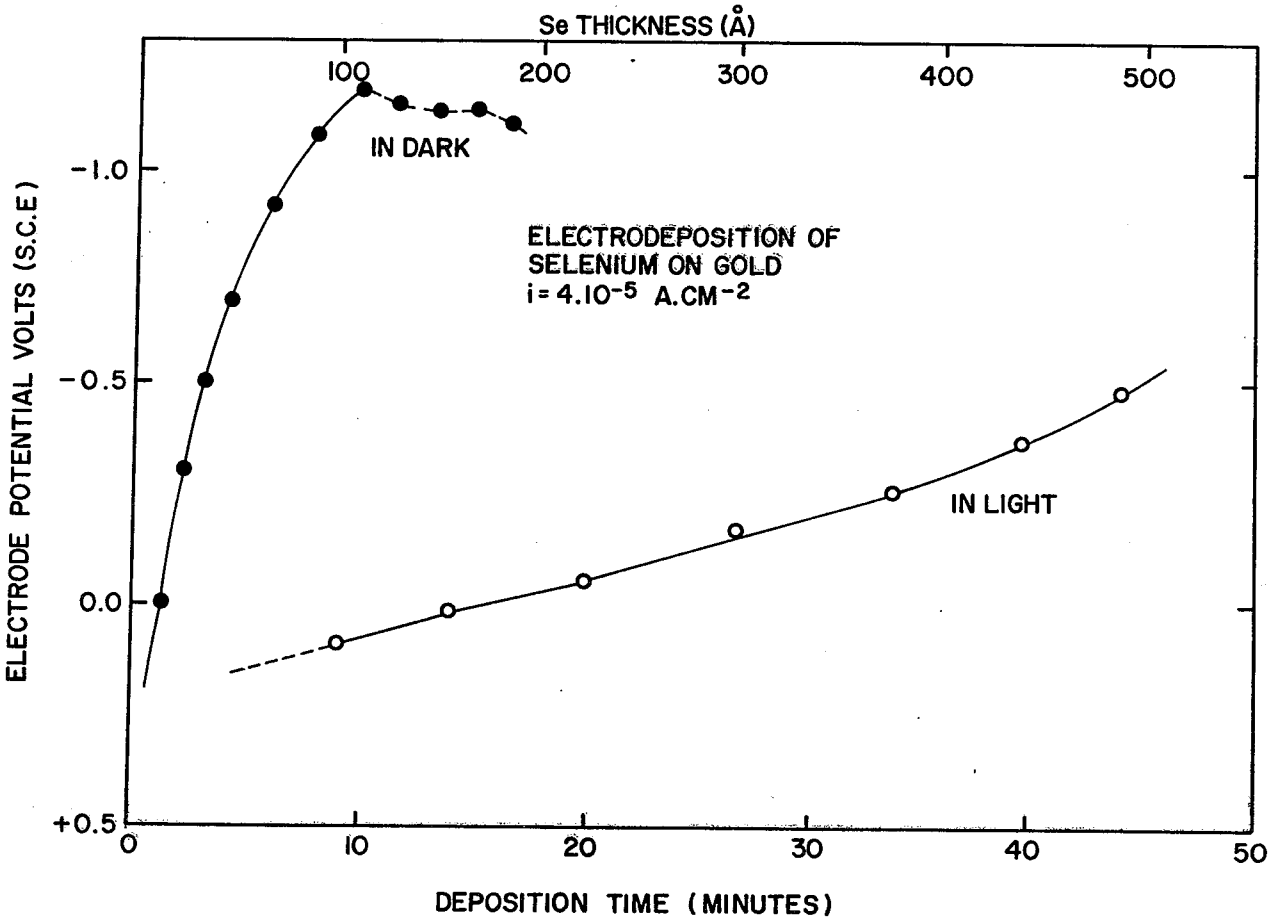
FIG. 3 is a graphical illustration of the variation of electrode potential vs. a reference electrode with time for the electrodeposition of amorphous selenium on gold in the dark and with illumination.

The necessary depolarization can be accomplished by illuminating the cathode 18 with light capable of generating enough charge carriers in the selenium layer to bear a significant portion of the applied current density. The effect of light on the cathode potential under galvanostatic conditions is illustrated in FIG. 3. The data shown in FIG. 3 where obtained with a gold cathode and illumination having a wavelength of 4416A at an intensity of $3 \times 10^{15}$ photons/cm$^2$/sec. The current passed through the electrolyte was $4 \times 10^{-5}$ A/cm$^2$. Of course this data will differ with different conditions, e.g. the wavelength and intensity of the radiation and the current level. The cathode potential was measured in light and dark with respect to a saturated calomel reference electrode (S.C.E.). In the dark deposition of only 100A of selenium on the gold cathode causes a rise of more than one volt in the cathode potential. The gold substrate/selenium interface is evidently very blocking to electrons. At the potential of $-1$ volt (vs. the S.C.E.) the electrical field of about $10^{-6}$ VCM$^{-1}$ across the selenium layer causes breakdown and pitting of the selenium layer by hydrogen evolution according to reaction (2). However, if the selenium layer is illuminated with enough light before breakdown can occur, then the rise in cathode potential is suppressed and deposition can be continued until several thousand angstroms of selenium have been deposited. The selenium layer thickness cannot be increased indefinitely, however, because for a given light intensity the potential drop across the selenium layer must increase so that ultimately competitive reaction (2) can occur even in the presence of the illumination. This typically limits the layer thickness to about the absorption depth of the illuminating radiation. Since this thickness is that desired for device applications, this limitation is not a constraint to the method of the invention. The situation depicted in FIG. 3 is typical of that encountered with substrates such as gold and NESA glass, a tin-oxide coated glass, which make contacts with selenium which are blocking to electrons. In these cases the deposition of selenium is light assisted and the deposition can be made to proceed preferentially in the light struck areas of the cathode.

During deposition of the selenium on the cathode the later is illuminated through a periodic spatial light modulating means with radiation within the absorption band of selenium. The illumination may be directed at the surface of the cathode in contact with the electrolyte or at the opposite surface thereof. Of course, the direction of the illumination will be dependent upon the properties of the substrate material which is acting as the cathode. Where the material is substantially transparent such as NESA glass, it is preferred to direct the illumination through the surface of the cathode which is not in contact with the electrolyte so as to avoid resolution losses which may arise from illuminating through the electrolyte. Moreover, in this embodiment the periodic spatial light modulating means may advantageously be placed in close proximity or in contact with the cathode. Where opaque substrate materials are used the illumination must be directed through the electrolyte in which case the anode 20 must be transparent. In this embodiment, a relatively thin cell is preferably used in order to minimize any resolution loss which may occur. The illumination may be narrow band such as that supplied by a laser or broad band.

The periodic spatial light modulating means may be of any suitable type such as a line screen or a halftone screen and it may be periodic in one or two directions. The electrodeposition technique is capable of faithfully reproducing frequencies of at least 1500 cycles/inch. Typically the periodic spatial light modulating means may have a frequency in the range of from about 150 cycles/inch to about 1500 cycles/inch.

The difference in thickness of the selenium deposit in the illuminated and non-illuminated areas of the substrate can be varied over a wide range by using the applied current density and light intensity to control the fraction of total current carried by the light-struck areas. Typical selenium thickness in the background areas is from about 100A to about 500A and typical thickness in the illuminated areas is from about 1000A to about 7000A.

After the amount of selenium deposited on the cathode has reached the desired thickness, deposition substantially ceases upon inactivation of the driving force of the cell. The cathode is then removed from the cell and the selenium deposit is washed and dried, preferably in a vacuum oven.

The selenium layer is then overcoated with a layer of a charge carrier transport material which is capable of transporting at least one species of charge carrier. This can be done by any suitable method such as, for example, by dip coating from a solution of the transport material or by a draw bar coating technique. The charge carrier transport material layer 16 typically has a thickness of from about 3 to about 20 microns. Any suitable charge carrier transport material may be used. Typical suitable transport materials include, for example, poly(N-vinylcarbazole), poly(vinylpyrene), poly(-vinylnaphthalene), poly(2-vinylanthracene) and poly(9-vinylanthracene). A charge carrier transport matrix may also be formed by combining one or more electronically inert polymers such as poly(vinylchloride) with one or more of the above-named transport materials. The method of combination of such electronicaly distinct polymers can include copolymerization (random, graft, block, etc.), formation of an interpenetrating polymer network and polymer blending. Alternatively an electronically inert polymer matrix can be rendered an efficient transporter of charge carriers by the incorporation within a film of such materials so-called "small molecules" capable of an efficient carrier transport. The term "small molecules" is inclusive of single molecules and low molecular weight polymers. These small molecules can be added to the casting or coating solution during formation of the polymeric matrix or can be subsequently introduced into the matrix by swelling of the polymeric materials of the matrix with a solution containing the small molecule compounds. Upon evaporation of the liquid phase of the solution, the small molecules will remain entrapped within the polymeric matrix thus enhancing charge carrier transport properties of this insulating film. These small molecules can also be added to active polymeric matrices in order to enhance the transport of charge carriers not readily transported by the electronically active polymer. For example, Lewis Acid can be added to a photoconductive polymer such as poly(N-vinylcarbazole) in order to improve electron transport. Representative of small molecule additives, which can be added to either an electronically active or inert polymer matrix to facilitate hole (+) transport include pyrene, anthracene, carbazole, triphenylamine, naphthalene, julolidine, indole and perylene. Small molecule additives, which can be incorporated into either an electronically active or inert polymer matrix to facilitate electron (−) transport include anthracene, fluorenone, 9-dicyanomethylene-fluorene, the nitro derivatives of fluorenone, the nitro derivatives of 9-dicyanomethylene-fluorene and chloranil. Both hole and electron small molecule transport materials can be used in combination with one another in inert polymers. A number of the above small molecules are known to form charge transfer complexes with both the inert and active polymer systems and some absorption by the matrix complex is permitted provided that the absorptivity of the resulting charge transfer complex does not compete with the selenium.

The electrophotographic imaging member 10 formed according to the method of the invention may be utilized to form reproductions of original objects according to the well known xerographic method. The member is electrostatically charged, exposed to an imagewise pattern of activating electromagnetic radiation to form an electrostatic latent image and then contacted with a developer material to form a visible image which is typically transferred to a permanent receiver member and fixed thereto. The member may then be cleaned to remove any residual developer material and used to form additional reproductions. The polarity of the electrostatic charge applied to the imaging member depends upon the nature of the charge carrier transport material. If the transport material is a hole transport material then the charging step is carried out with negative polarity whereas a positive polarity charge is used when the transport material transports electrons. Of course if the transport material is capable of transporting either species of charge carrier then the charging step may be of either polarity.

The electrophotographic imaging member is capable of providing unusual imaging effects in the xerographic mode. Because of the periodic thickness variation of the selenium layer the member will reproduce solid area image information via the introduction of additional fringe fields in the electrostatic latent image. Moreover, the sub-micron dimension of the selenium layer thickness provides extended dynamic range and halftone capability by a mechanism which differs from that normally associated with thickness-modulated vacuum deposited selenium photoconductive layers. In the present instance, the spatially periodic variation in photoreceptor sensitivity necessary for halftone rendition is associated with the spatially periodic variation of the optical absorption properties of the selenium layer. For example, light of a wavelength which is essentially 100% absorbed in the thick regions of the selenium layer may be only 30% absorbed in the thin regions of that layer. This causes a corresponding difference in the photoresponse of the thick and thin regions to this particular wavelength. This cannot be the mechanism of operation of vacuum deposited selenium layers normally employed in the art because such layers, even when thickness modulated, are essentially 100% light absorbing in all regions.

The invention will now be further described in detail with respect to specific preferred embodiments by way of Examples, it being understood that these are intended to be illustrative only and the invention is not limited to the materials, conditions, process parameters, etc., recited therein. All percentages recited are by weight unless otherwise specified.

EXAMPLE I

An electrodeposition cell was set up with an approximately 4 inches × 4 inches NESA glass plate as the cathode and another NESA glass plate as the anode. The active area of the electrodes was about 20 $cm^2$. 500 ml of a 0.1M electrolyte were prepared by dissolving 5.55 grams of ultrapure selenium dioxide (Alfa Inorganics, Ventron Corporation, Beverly, Mass.) in triply-distilled water which contained 2.5 ml of 2N $H_2SO_4$ and placed in the cell. The cell and the electrolyte were deoxygenated with nitrogen in situ for about five minutes. The selenious acid was then electrolyzed at a constant current density of about $1.5 \times 10^{-4}$ A/$cm^2$ for 28 minutes. The constant current density was achieved by passing 100 volts from a Kepco D.C. power supply through a 30 KΩ resistance in series with the cell.

During the time the constant current was being passed through the electrolyte, the back (non-conducting) surface of the NESA cathode was illuminated through a 150 cycles per inch screen (periodic in two directions) arranged in contact with the back of the cathode with 4416A light obtained by expanding the normal output beam from a Spectra Physics Model 185 He-Cd laser operated at 24mW with a Spectra Physics Model 334 expanding lens assembly. After selenium deposition was terminated the cathode was removed from the cell. The selenium layer formed on the conducting surface of the NESA plate had a periodically varying thickness which represented a high fidelity replication of the screen. The plate was washed with triply-distilled water and dried in a vacuum oven.

The selenium layer was then overcoated with an approximately 6 micron thick poly(N-vinylcarbazole) layer by draw bar coating a 9% solution of poly(N-vinylcarbazole) (Luvican from BASF Corp.) in Baker Chemical Co. spectrograde chloroform. The member was then dried in a vacuum oven overnight at room temperature.

The electrophotographic imaging member was utilized to form a reproduction of an original continuous tone object using a Xerox Model D Processor. The member was charged with negative polarity and development was by the open cascade (line tray) mode. Exposure was for 8 seconds at *f* 16. A good quality reproduction of the original object was obtained.

EXAMPLE II

The procedure described in Example I was repeated identically with the exception that the substrate of the imaging member was a NESA glass plate coated with a few hundred angstrom thick layer of phenoxy resin. Again a good quality reproduction of the original object was obtained.

Although the invention has been described with respect to various preferred embodiments thereof, it is not intended to be limited thereto but rather those skilled in the art will recognize that modifications and variations may be made therein which are within the spirit of the invention and the scope of the claims.

What is claimed is:

1. A method for forming an electrophotographic imaging member comprising a conducting substrate, a layer of amorphous selenium having a periodically varying thickness and a layer of a charge carrier transport material capable of transporting at least one species of charge carrier comprising:

a. cathodically depositing a layer of amorphous selenium on a conducting substrate from a selenious acid electrolyte while simultaneously illuminating said substrate with a periodic spatially modulated pattern of electromagnetic radiation within the absorption band of selenium whereby said selenium layer has a periodically varying thickness which corresponds to said periodic spatially modulated pattern; and b. overcoating said selenium layer with a layer of a charge carrier transport material which is capable of transporting at least one species of charge carrier.

2. The method as defined in claim 1 wherein said substrate is capable of forming a blocking contact with amorphous selenium.

3. The method as defined in claim 1 wherein said charge carrier transport material is a hole transport material.

4. The method as defined in claim 1 wherein said charge carrier transport material is an electron transport material.

5. The method as defined in claim 1 wherein said periodic spatially modulated pattern of electromagnetic radiation has a frequency of at least about 150 cycles per inch.

6. The method as defined in claim 1 wherein said substrate material is gold.

7. The method as defined in claim 1 wherein said substrate material is nickel.

* * * * *